US008737894B2

(12) United States Patent
Suzuki

(10) Patent No.: US 8,737,894 B2
(45) Date of Patent: May 27, 2014

(54) FIXING DEVICE HAVING FLEXIBLE FUSING MEMBER

(75) Inventor: Noboru Suzuki, Komaki (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 56 days.

(21) Appl. No.: 13/337,697

(22) Filed: Dec. 27, 2011

(65) Prior Publication Data

US 2012/0163886 A1 Jun. 28, 2012

(30) Foreign Application Priority Data

Dec. 28, 2010 (JP) ..... 2010-292746

(51) Int. Cl.
*G03G 15/20* (2006.01)

(52) U.S. Cl.
USPC ..... 399/329; 399/333

(58) Field of Classification Search
USPC ..... 399/328, 329, 330, 333
See application file for complete search history.

(56) References Cited

U.S. PATENT DOCUMENTS

| | | | | |
|---|---|---|---|---|
| 7,215,916 | B2 * | 5/2007 | Kishino et al. | 399/329 |
| 7,437,111 | B2 | 10/2008 | Yamada et al. | |
| 7,502,585 | B2 | 3/2009 | Uehara et al. | |
| 7,702,271 | B2 | 4/2010 | Yamada et al. | |
| 7,881,650 | B2 | 2/2011 | Shin et al. | |
| 2003/0042241 | A1 | 3/2003 | Uekawa et al. | |
| 2005/0100373 | A1 | 5/2005 | Kishino et al. | |
| 2005/0180786 | A1 | 8/2005 | Yamada et al. | |
| 2006/0177251 | A1 | 8/2006 | Uehara et al. | |
| 2007/0147915 | A1 | 6/2007 | Kishino et al. | |
| 2008/0199233 | A1 | 8/2008 | Matsunaka et al. | |
| 2009/0010687 | A1 | 1/2009 | Yamada et al. | |
| 2009/0092423 | A1 | 4/2009 | Shin et al. | |

FOREIGN PATENT DOCUMENTS

| | | | |
|---|---|---|---|
| CN | 1619436 | A | 5/2005 |
| CN | 1661494 | A | 8/2005 |
| CN | 1818810 | A | 8/2006 |
| JP | 2001-068261 | A | 3/2001 |
| JP | 2003-131502 | | 5/2003 |
| JP | 2003-168542 | | 6/2003 |
| JP | 2003-263060 | A | 9/2003 |
| JP | 2004-287078 | A | 10/2004 |
| JP | 2006-220950 | A | 8/2006 |
| JP | 2009-093141 | | 4/2009 |

OTHER PUBLICATIONS

JP Office Action dtd Jan. 22, 2013, JP Appln. 2010-292746, English translation.
Extended EP Search Report mailed May 3, 2012, EP Appln. 11192397.5-2216.
CN First Office Action mailed Jan. 21, 2014, CN Appln. 201110447703.5, English Translation.

* cited by examiner

*Primary Examiner* — Hoang Ngo
(74) *Attorney, Agent, or Firm* — Banner & Witcoff, Ltd.

(57) ABSTRACT

A fixing device includes a tubular flexible metallic fusing member, a heater, a nip member, and a backup member. The fusing member has an inner peripheral surface defining an internal space. The heater is disposed in the internal space. The nip member is disposed in the internal space for receiving radiant heat from the heater and has a contact surface in sliding contact with the inner peripheral surface. At least the contact surface is provided with a protection layer having a hardness higher than that of the inner peripheral surface. The backup member nips the fusing member in cooperation with the nip member.

12 Claims, 5 Drawing Sheets

FIXING DEVICE HAVING FLEXIBLE FUSING MEMBER

CROSS REFERENCE TO RELATED APPLICATION

This application claims priority from Japanese Patent Application No. 2010-292746 filed Dec. 28, 2010. The entire content of this priority application is incorporated herein by reference.

TECHNICAL FIELD

The present invention relates to a fixing device mounted in an electrophotographic type image forming device.

BACKGROUND

A conventional fixing device includes a cylindrical fusing film having an internal space and an inner surface, a heater disposed in the internal space, a nip plate in sliding contact with the inner surface, and a pressure roller that nips the fusing film in cooperation with the nip plate. A sheet carrying a toner image is passed through a nip portion defined between the fusing film and the pressure roller, so that the toner image can be thermally fixed onto the sheet.

The fusing film of the conventional fixing device is made from flexible metal such as stainless steel or nickel, and the nip unit of the conventional fixing device is made from metal such as aluminum, copper, or their alloys.

SUMMARY

The present inventor has found drawback in the disclosed conventional fixing device. That is, since hardness of aluminum or copper is lower than that of stainless steel, the nip plate is softer than the fusing film, the nip plate may be frictionally worn down due to continuous sliding contact with the fusing film. Consequently, service life of the nip plate may be reduced.

In view of the foregoing, it is an object of the invention to provide a fixing device capable of suppressing a wear or abrasion of the nip plate for prolonging service life thereof.

In order to attain the above and other objects, the present invention provides a fixing device. The fixing device includes a tubular flexible metallic fusing member, a heater, a nip member, and a backup member. The fusing member has an inner peripheral surface defining an internal space. The heater is disposed in the internal space. The nip member is disposed in the internal space for receiving radiant heat from the heater and has a contact surface in sliding contact with the inner peripheral surface, At least the contact surface is provided with a protection layer having a hardness higher than that of the inner peripheral surface. The backup member nips the fusing member in cooperation with the nip member.

According to another aspect, the present invention provides a fixing device. The fixing device includes a tubular flexible metallic fusing member, a nip member, and a backup member, The fusing member has an inner peripheral surface made from metal and defining an internal space. The nip member is made from metal and has a contact surface configured to be in sliding contact with the inner peripheral surface. At least the contact surface is provided with a protection layer having a hardness higher than that of the inner peripheral surface. The backup member nips the fusing member in cooperation with the nip member.

BRIEF DESCRIPTION OF THE DRAWINGS

The particular features and advantages of the invention as well as other objects will become apparent from the following description taken in connection with the accompanying drawings, in which.

DETAILED DESCRIPTION

Next, a general structure of a laser printer as an image forming device according to an embodiment of the present invention will be described with reference to accompany drawings. The laser printer 1 shown in FIG. 1 is provided with a fixing device 100 according to the embodiment of the present invention, A detailed structure of the fixing device 100 will be described later.

<General Structure of Laser Printer>

Figure 1:
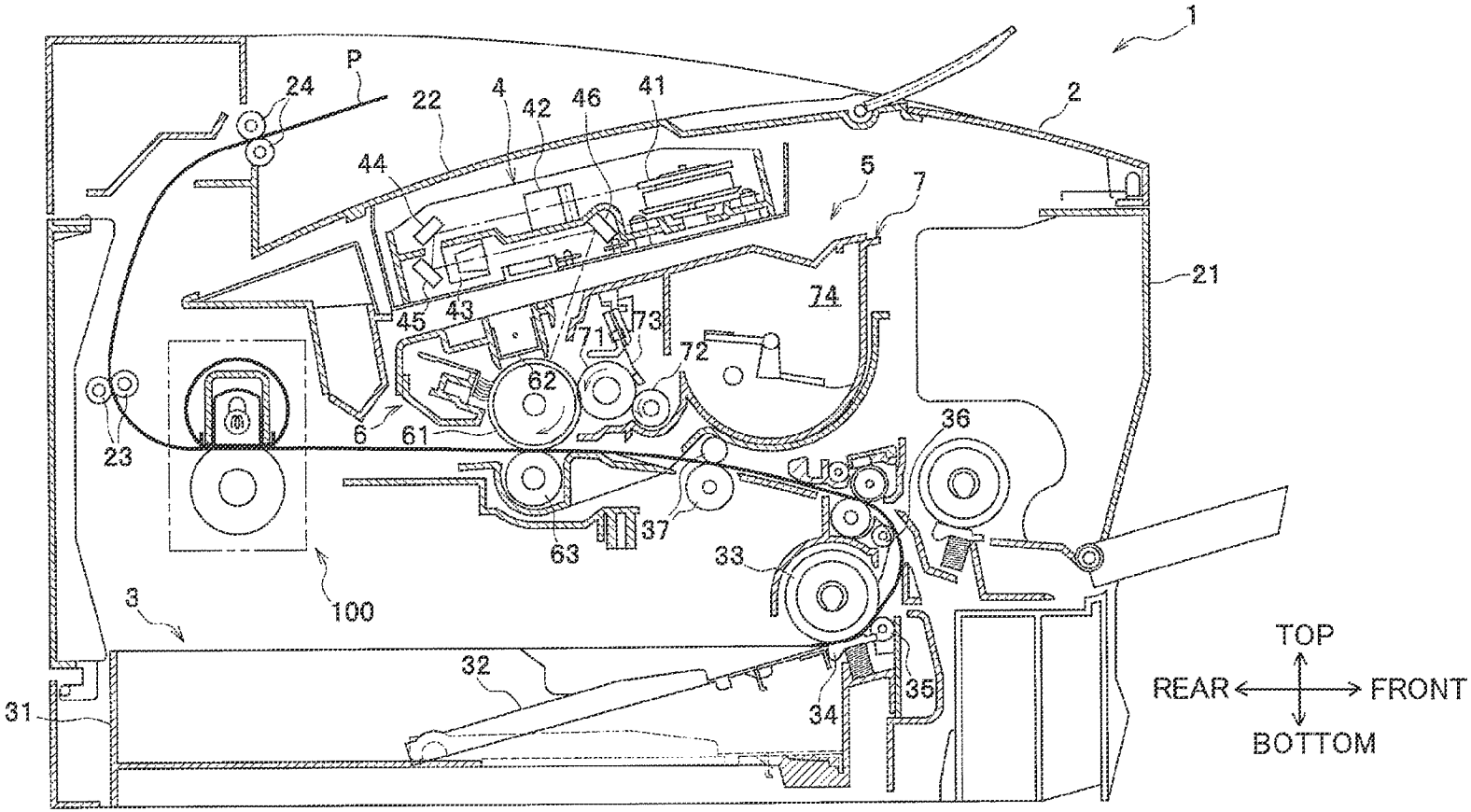
FIG. 1 is a schematic cross-sectional view showing a structure of a laser printer having a fixing device according to an embodiment of the present invention.

As shown in FIG. 1, the laser printer 1 includes a main frame 2 with a movable front cover 21. Within the main frame 2, a sheet supply unit 3 for supplying a sheet P, an exposure unit 4, a process cartridge 5 for transferring a toner image (developing agent image) on the sheet P, and the fixing device 100 for thermally fixing the toner image onto the sheet P are provided.

Throughout the specification, the terms "above", "below", "right", "left", "front", "rear" and the like will be used assuming that the laser printer 1 is disposed in an orientation in which it is intended to be used. More specifically, in FIG. 1, a left side and a right side are a rear side and a front side, respectively.

The main frame 2 has a lower portion where the sheet supply unit 3 is disposed. The sheet supply unit 3 includes a sheet supply tray 31 for accommodating the sheet P, a lifter plate 32 for lifting up a front side of the sheet P, a sheet supply roller 33, a sheet supply pad 34, paper dust removing rollers 35, 36, and registration rollers 37. Each sheet P accommodated in the sheet supply tray 31 is directed upward to the sheet supply roller 33 by the lifter plate 32, separated by the sheet supply roller 33 and the sheet supply pad 34, and conveyed toward the process cartridge 5 passing through the paper dust removing rollers 35, 36, and the registration rollers 37.

The main frame 2 has an upper portion where exposure unit 4 is disposed. The exposure unit 4 includes a laser emission unit (not shown), a polygon mirror 41, lenses 42, 43, and reflection mirrors 44, 45, 46. in the exposure unit 4, the laser emission unit is adapted to project a laser beam (indicated by a chain line in Fig, 1) based on image data so that the laser beam is deflected by or passes through the polygon. mirror 41, the lens 42, the reflection mirrors 44, 45, the lens 43, and the reflection mirror 46 in this order. A surface of a photosensitive drum 61 is subjected to high speed scan of the laser beam.

The process cartridge 5 is disposed below the exposure unit 4. The process cartridge 5 is detachable or attachable relative to the main frame 2 through a front opening defined by the front cover 21 at an open position. The process cartridge 5 includes a drum unit 6 and a developing unit 7.

The drum unit 6 includes the photosensitive drum 61, a charger 62, and a transfer roller 63. The developing unit 7 is detachably mounted to the drum unit 6. The developing unit 7 includes a developing roller 71, a toner supply roller 72, a regulation blade 73, and a toner accommodating portion 74 in which toner (developing agent) is accommodated.

In the process cartridge 5, after the surface of the photosensitive drum 61 has been uniformly charged by the charger 62, the surface is subjected to high speed scan of the laser beam from the exposure unit 4. An electrostatic latent image based on the image data is thereby formed on the surface of the photosensitive drum 61. The toner accommodated in the toner accommodating portion 74 is supplied to the developing roller 71 via the toner supply roller 72. The toner is conveyed between the developing roller 71 and the regulation blade 73 so as to be deposited on the developing roller 71 as a thin layer having a uniform thickness.

The toner deposited on the developing roller 71 is supplied to the electrostatic latent image formed on the photosensitive drum 61. Hence, a visible toner image corresponding to the electrostatic latent image is formed on the photosensitive drum 61. Then, the sheet P is conveyed between the photosensitive drum 61 and the transfer roller 63, so that the toner image farmed on the photosensitive drum 61 is transferred onto the sheet P.

The fixing device 100 is disposed rearward of the process cartridge 5. The toner image (toner) transferred onto the sheet P is thermally fixed on the sheet P while the sheet P passes through the fixing device 100, The sheet P on which the toner image is thermally fixed is conveyed by conveying rollers 23 and 24 so as to be discharged on a discharge tray 22.

<Detailed Structure of Fixing Device>

Figure 2:
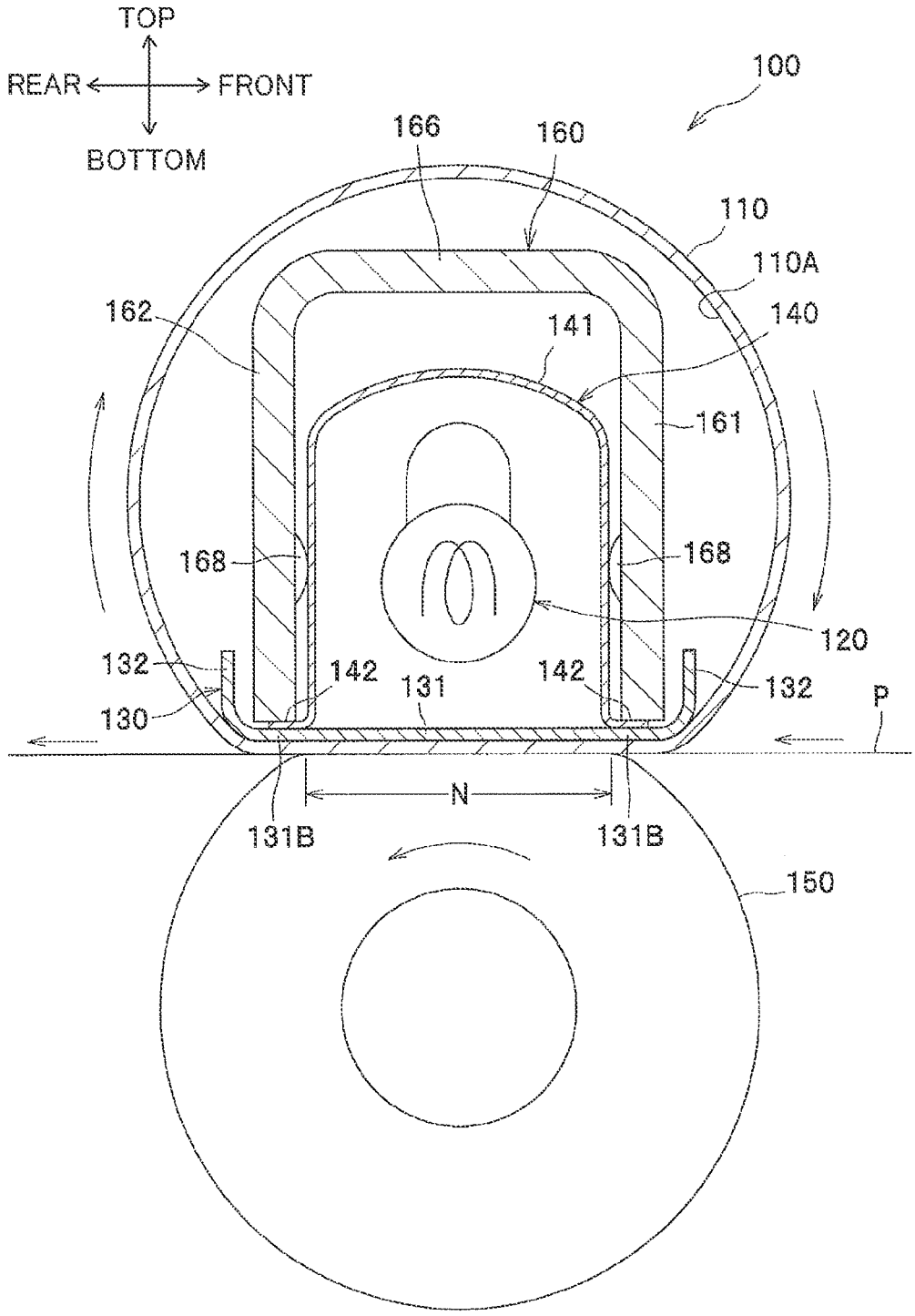
FIG. 2 is a schematic cross-sectional view showing a structure of the fixing device.

As shown in FIG. 2, the fixing device 100 includes a casing, a flexible tubular fusing member such as a tube or film 110, a halogen lamp 120, a nip plate 130, a reflection plate 140, a pressure roller 150, and a stay 160.

The fusing film 110 is of a tubular configuration having flexibility. The fusing film 110 has an inner surface 110A and an internal space for accommodating the halogen lamp 120, the nip plate 130, the reflection plate 140, and the stay 160. In the embodiment, the fusing film 110 is made from stainless steel such as SUS 304; The rotation of the fusing film 110 is guided by a guide member (not shown) at its axial ends. The fusing film 110 corresponds to a fusing member of the present invention.

The halogen lamp 120 is a heater to heat the nip plate 130 and the fusing film 110 for heating toner on the sheet P. The halogen lamp 120 is positioned at the internal space of the fusing film 110. The halogen lamp 120 is separated from the fusing film 110 and the nip plate 130 by a predetermined distance.

The nip plate 130 is of a plate shape and in sliding contact with the inner surface 110A. of the fusing film 110. The nip plate 130 is adapted for receiving resident heat from the halogen lamp 120 and for transmitting resident heat to the toner on the sheet P through the fusing film 110. The nip plate 130 corresponds to a nip member of the present invention.

Figure 3:
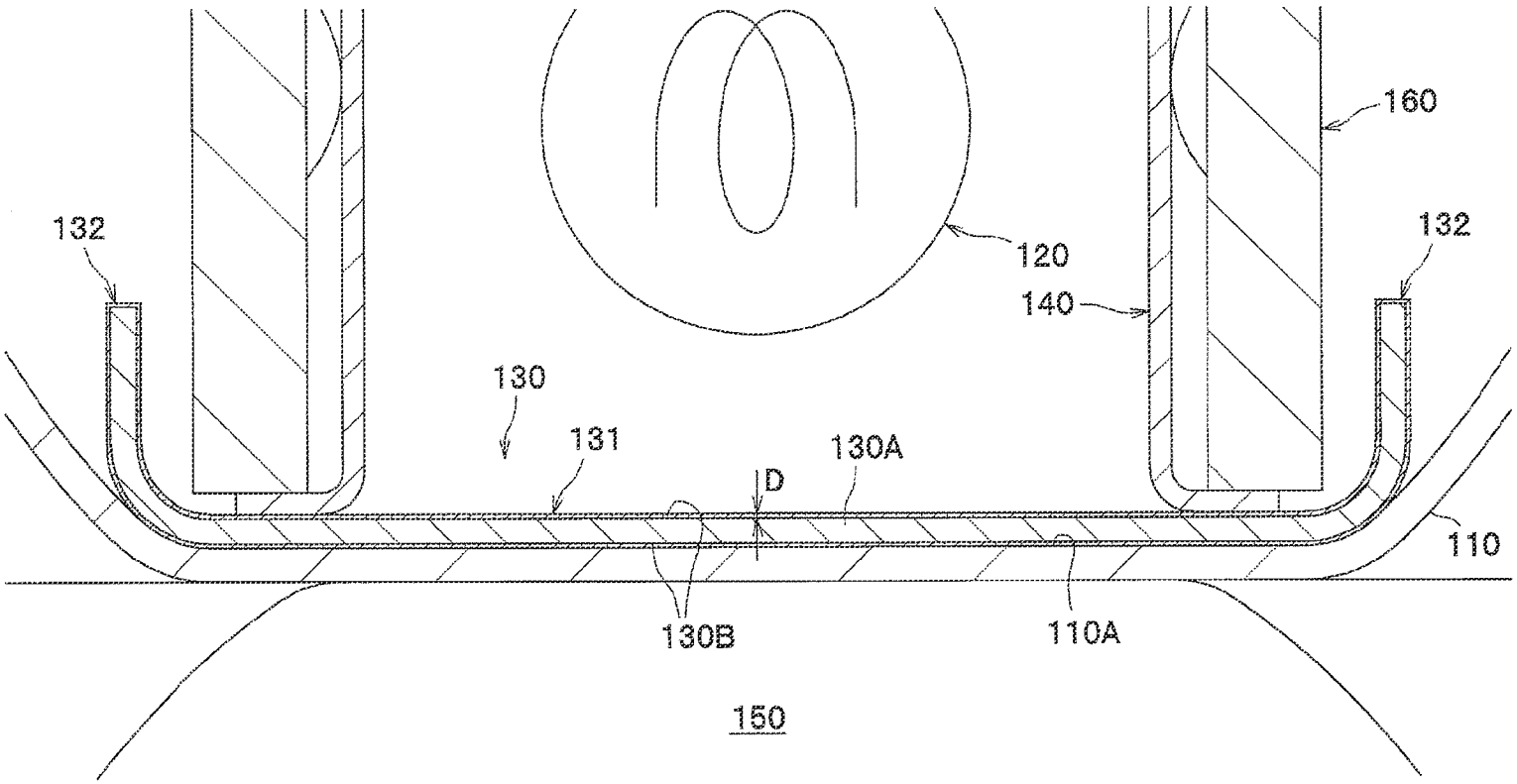
FIG. 3 is an enlarged schematic cross-sectional view showing a structure around a nip plate of the fixing device.

As shown in FIG. 3, the nip plate 130 includes a metallic main body 130A and a protection layer 130B entirely covering over an outer surface of the main body 130A. The protection layer 130B is in direct sliding contact with the inner surface 110A of the fusing film 110.

The main body 130A is made from plate-shaped aluminum alloy, for example A5052, having thermal conductivity greater than that of the stay 160 made from steel. The nip plate 130 is produced by folding the plate-shaped aluminum alloy into substantially like a latter U in a cross-sectional view.

Figure 4:
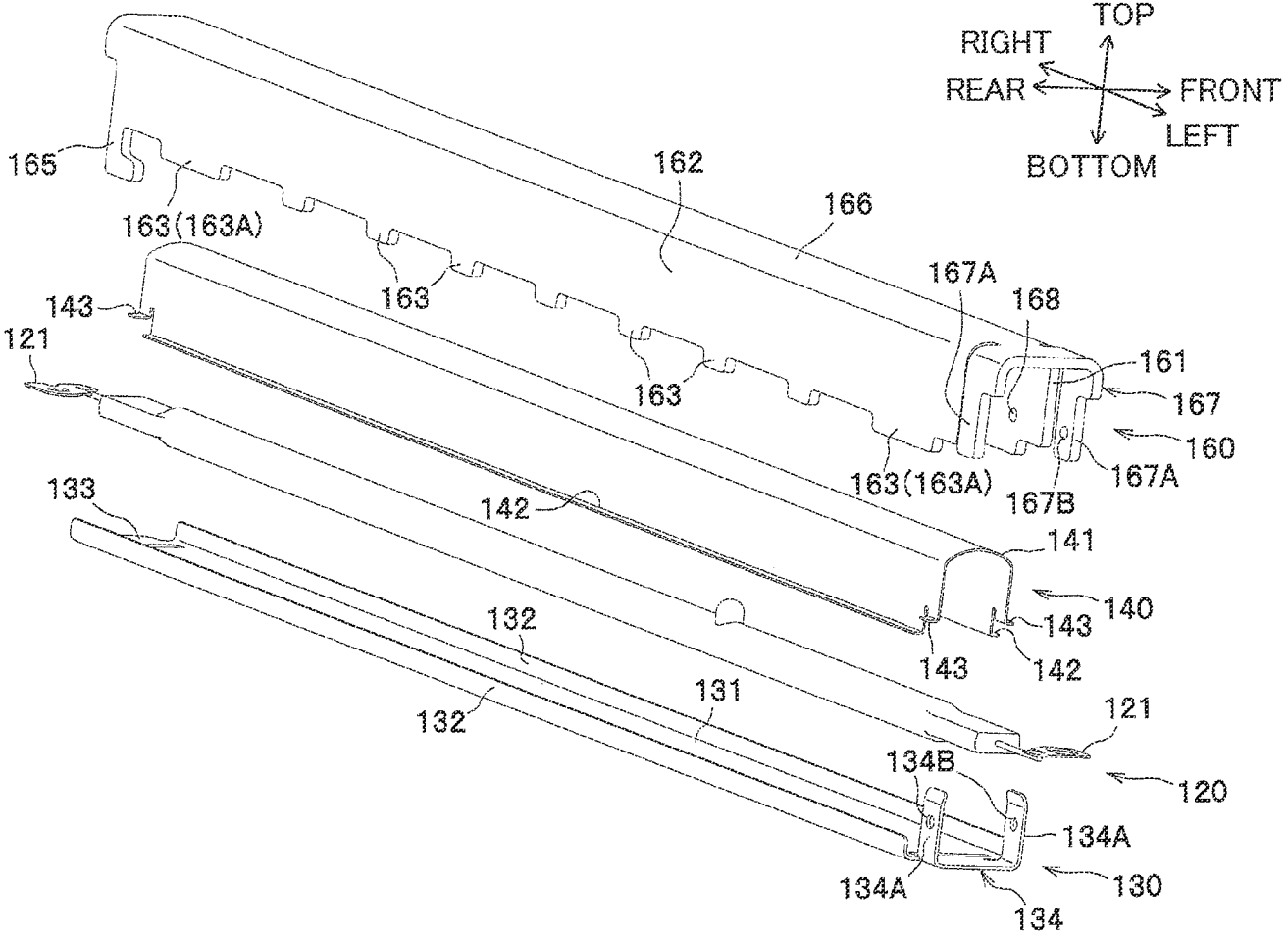
FIG. 4 is an exploded perspective view showing a halogen lamp, a nip plate, a reflection plate, and a stay.

The main body 130A includes, in the cross-sectional view, a base portion 131. extending in the front-to-rear direction and a bending portion 132 extending upward (in a direction from the pressure roller 150 to the nip plate 130). As shown in FIG. 4, the main body 130A has a right end portion provided with an insertion portion 133 extending flat, and a left end portion provided with an engagement portion 134. The engagement portion 134 has U-shaped configuration as viewed from a left side and includes side wall portions 134A extending upward and formed with engagement holes 134B.

Turning back to FIG. 3, the protection layer 130B has a hardness higher than that of the inner surface 110A of the fusing film 110 made from stainless steel, (Typical stainless steel is SUS304 having approximately 400 Vickers hardness.) Thus, the protection layer 30B has a hardness higher than Hv 400.

The protection layer 130B is formed by forming a layer made from material having a hardness higher than that of the stainless steel and different from the material of the main body 130A (aluminum alloy). Particularly, the protection layer 130B is a nickel-phosphorus alloy plating layer produced by electroless nickel-phosphorus plating treatment on the outer surface of the main body 130A. The nickel-phosphorus alloy plating layer is then subjected to a baking treatment, for example at a temperature of 200 degrees centigrade for one hour. As a result, a baking layer is formed on the nickel-phosphorus alloy plating layer, so that the protection layer 130B has a hardness of ranging from 500 to 700 Vickers hardness.

The protection layer 130B has a thickness D ranging from approximately 5 to 15 micrometers. The thickness D is not less than 5 micrometers to obtain sufficient durability of the protection layer 130B, and not more than 15 micrometers to maintain productivity and stability or uniformly of the protection layer 130B. For example, if the main body 130A has a thickness of 0.6 millimeters, the protection layer 130B has a thickness D of 10.0 micrometers. In FIG. 3, the thickness D is exaggerated in order to depict the protection layer 130B.

The base portion 131 has an inner surface (upper surface) possibly painted with black color or provided with a heat absorbing member, and a contact surface (lower surface) directly in sliding contact with the inner surface 110A. The nip plate 130 effectively receives resident heat from the halogen lamp 120.

A lubricant such as, for example, heat-resistant fluorine grease (not shown in the drawings) is provided between the contact surface of the nip plate 130 and the fusing film 110 to decrease sliding friction therebetween. Accordingly, the fusing film 110 can be smoothly rotated or circularly moved.

The reflection plate 140 is adapted to reflect radiant heat radiating in the front-to-rear direction and the upper direction from the halogen lamp 120 toward the nip plate 130 (toward the inner surface of the base portion 131), As shown in FIG. 2, the reflection plate 140 is positioned in the fusing film 110 and surrounds the halogen lamp 120, with a predetermined distance therefrom. Thus, radiant heat from the halogen lamp 120 can be efficiently concentrated onto the nip plate 130 to promptly heat the nip plate 130 and the fusing film 110.

The reflection plate 140 is configured into U-shape in cross-section and is made from a material such as aluminum having high reflection ratio regarding infrared ray and far infrared ray. The reflection plate 140 has a U-shaped reflection portion 141 and a flange portion 142 extending from each end portion of the reflection portion 141 in the front-to-rear direction. A mirror surface finishing is available on the surface of the aluminum reflection plate 140 for specular reflection in order to enhance heat reflection ratio.

Figure 5:
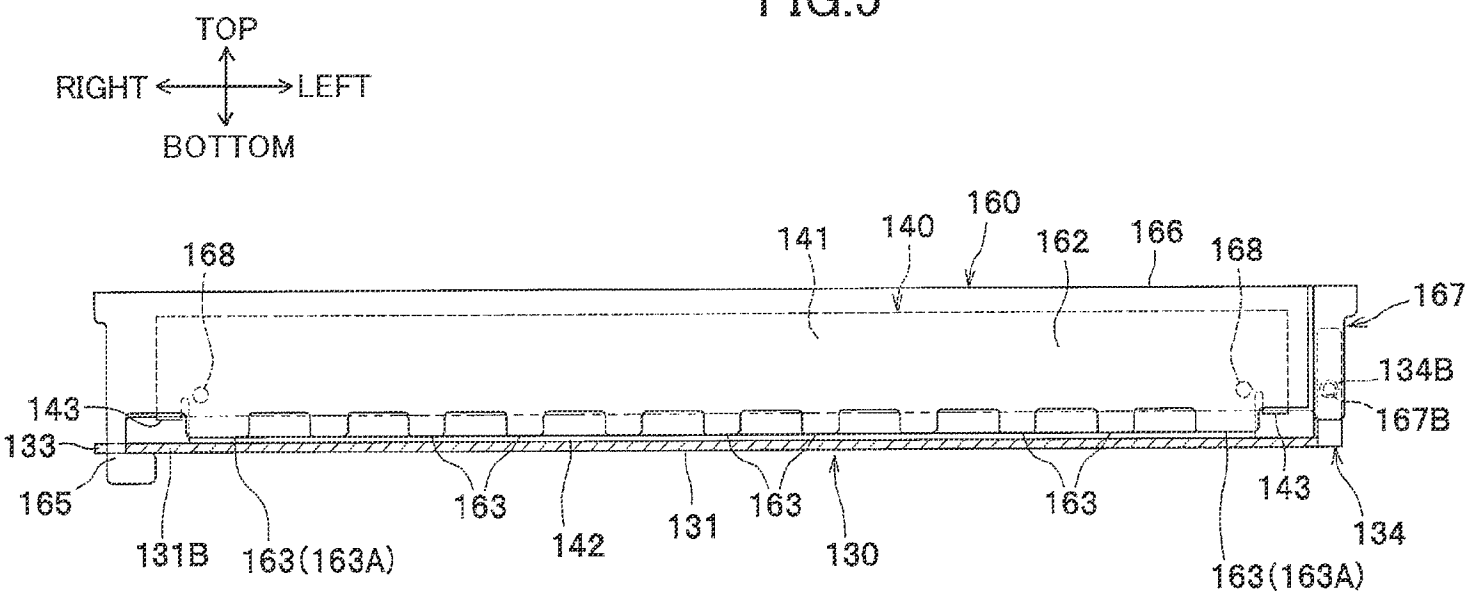
FIG. 5 is a side view showing an assembled state of the nip plate, the reflection plate and the stay.

As shown in FIG. 4, two engagement sections 143 are provided at each axial end of the reflection plate 140. Each engagement section 143 is positioned higher than the flange portion 142. As a result of assembly of the nip plate 130 together with the reflection plate 140 and the stay 160 as shown in FIG. 5, a comb-like contact portions 163 of the stay 160 described later are nipped between the right and left engagement sections 143. That is, the right engagement section 143 is in contact with the rightmost contact portion 163A, and the left engagement section 143 is in contact with the leftmost contact portion 163A.

As a result, displacement of the reflection plate 140 in the right-to-left direction due to vibration caused by operation of the fixing device 100 can be restrained by the engagement between the engagement sections 143 and the comb-like contact portions 163A.

As shown in FIG. 2, the pressure roller 150 is elastically deformable and positioned below the nip plate 130. The deformed pressure roller 150 nips the fusing film 110 in cooperation with the nip plate 130 to provide a nip region N for nipping the sheet P between the pressure roller 150 and the fusing film 110. To provide the nip region N, a biasing member such as a spring urges one of the nip plate 130 and the pressure roller 150 toward the other. The pressure roller 150 corresponds to a backup member of the present invention.

The pressure roller 150 is rotationally driven by a drive motor (not shown) disposed in the main frame 2. By the rotation of the pressure roller 150, the fusing film 110 is circularly moved along the nip plate 130 because of a friction force generated therebetween or between the sheet P and the fusing film 110. A toner image on the sheet P can be thermally fixed thereto by heat and pressure during passage of the sheet P at the nip region N between the pressure roller 150 and the fusing film 110.

The stay 160 is adapted to support the end portions 131B of the nip plate 130 via the flange portion 142 of the reflection plate 140 for maintaining rigidity of the nip plate 130. The stay 160 has a U-shape configuration in conformity with the outer shape of the reflection portion 141 covering the reflection plate 140. For fabricating the stay 160, a highly rigid member such as a steel plate is folded into U-shape to have a top wall 166, a front wall 161 and a rear wall 162. As shown in FIG. 4, each of the front wall 161 and the rear wall 162 has a lower end portion provided with comb-like contact portions 163.

The front and rear walls 161, 162 have right end portions provided with L shaped engagement legs 165 each extending downward and then leftward. The top wall 166 has a left end portion provided with a retainer 167 having U-shaped configuration. The retainer 167 has a pair of retaining walls 167A whose inner surfaces are provided with engagement bosses 167B protruding inward.

As shown in FIGS. 2 and 4, each axial end portion of each of the front wall 161 and the rear wall 162 has an inner surface provided with two abutment bosses 168 protruding inward in abutment with front and rear side walls of the reflection plate 140 in the front-to-rear direction. Therefore, displacement of the reflection plate 140 in the front-to-rear direction due to vibration caused by operation of the fixing device 100 can be restrained because of the abutment of the reflection portion 141 with the bosses 168.

Assembling procedure of the reflection plate 140 and the nip plate 130 to the stay 160 will be described. First, the reflection plate 140 is temporarily assembled to the stay 160 by the abutment of the outer surface of the reflection portion 141 on the abutment bosses 168. In this case, the engagement sections 143 are in contact with the axial endmost contact portions 163A.

Then, as shown in Fig, 5, the insertion portion 133 is inserted between the engagement legs 165 and 165, so that the base portion 131 can be brought into engagement with the engagement legs 165. Thereafter, the engagement bosses 167B are engaged with the engagement holes 134B.

The end portion 131B of the base portion 131 is supported on the engagement legs 165 and the engagement portion 134 is supported on the retainer 167. Each flange portion 142 is sandwiched between the nip plate 130 and the stay 160, Thus, the nip plate 130 and the reflection plate 140 are held to the stay 160.

Vertical displacement of the reflection plate 140 due to vibration caused by operation of the fixing device 100 can be restrained, since the flange portions 142 are held between the nip plate 130 and the stay 160 as shown in FIG. 2. Thus, position of the reflection plate 140 relative to the nip plate 130 can be fixed.

The nip plate 130, the reflection plate 140, the stay 160, and the halogen lamp 120 are held on the guide member (not shown) for guiding the rotation of the fusing film 110. The guide member is supported to the casing of the fixing device 100, and therefore the fusing film 110, the halogen lamp 120, the nip plate 130, the reflection plate 140, and the stay 160 are supported to the fixing device 100.

With the structure, the following advantages can be obtained. The protection layer 130B has hardness of about Hv 500 to 700 higher than that of the inner surface 110A, and entirely covers the outer surface of the main body 130A made from a metal. Therefore, even if the protection layer 130B is in continuous sliding contact with the inner surface 110A made from stainless steel SUS304 having Hv 400, the wear of the nip plate 130 can be restrained. Accordingly, prolonged service life of the nip plate 130 and the fixing device 100 can result.

Frictional wearing of the fusing film 110 can be ignored in the fixing device 100 despite the fact that hardness of the protection layer 130B is higher than that of the inner surface 110A. This is because stainless steel specifically SUS304 is a wear resistant material in comparison with its hardness.

Only the contact surface of the nip plate 130 is in direct and constant sliding contact with the inner surface 110A so that the contact surface tends to wear down. To prevent this wear, the outer surface of the nip plate 130 is covered with the protection layer 130B whose hardness is higher than that of the inner surface 110A. On the other hand, the inner surface 110A of the fusing film 110 has a contact portion in sliding contact with the contact surface of the nip plate 130, and the contact portion consecutively changes because of the rotation or circular motion of the fusing film 110. Additionally, the lubricant is provided between the fusing film 110 and the nip plate 130. Thus, the fusing film 110 is difficult to wear down.

In the embodiment, the protection layer 130B is provided between the main body 130A made from metal and the fusing film 110 made from metal to avoid direct contact therebetween. This configuration can prevent bimetallic corrosion (electrochemical corrosion) of one of the fusing film 110 and the nip plate 130 due to the difference of ionization tendency between these metals.

Specifically, when dissimilar metals contact with each other and dew condensation is generated, one of the dissimilar metals is possibly corroded due to the difference of ionization tendency. If one of dissimilar metals is made from steel and the other is made from aluminum having larger ionization tendency than that of steel, aluminum tends to be corroded. In the embodiment, forming the protection layer 130B on the outer surface of the nip plate 130 can restrain corrosion of the main body 130A.

In the embodiment, material of the inner surface 110A and the protection layer 130B is preferably selected such that their ionization tendency is close to each other, in order to avoid the bimetallic corrosion of the fusing film 110 and the protection layer 130B.

In the embodiment, the protection layer 130B is formed on the outer surface of the main body 130A by the plating treatment so as to make the material of the protection layer different from the material of the main body 130A. Thus, the material for the protection layer 130B can be selected in a wide range.

While the invention has been described in detail with reference to the above aspects thereof, it would be apparent to those skilled in the art that various changes and modifications may be made therein without departing from the spirit of the invention.

In the above-described embodiment, the protection layer 130B is formed by the baking treatment after the plating treatment on the outer surface of the main body 130A. However, the present invention is not limited to this protection layer. For example, the protection layer may be formed by only the plating treatment without performing the baking treatment. Incidentally, in the above-described embodiment, the baking treatment after the electroless nickel plating treatment causes the protection layer to increase its hardness. Consequently, the protection layer having high hardness can be formed.

Forming the protection layer is not limited to the plating treatment in which the plating material is different from the material of the main body. Instead, a protection layer is formed by transforming the outer surface portion of the main body into a high hardness layer having a hardness higher than that of the inner surface of the fusing film, e.g., nitriding treatment or oxidation treatment. If the main body is made from aluminum, the protection layer on the outer surface portion of the main body is formed by alumite treatment to transform the outer surface portion into alumite. In other words, the high hardness layer formed by the alumite treatment functions as the protection layer.

In the above described embodiment, the main body 130A is entirely covered with the protection layer 130B. However, the present invention is not limited to this configuration. The protection layer can be formed on at least the contact surface in sliding contact with the inner surface of the fusing film.

In the above described embodiment, the main body 130A is made from aluminum alloy. However, the main body can be made from aluminum, copper, or copper alloy.

In the above described embodiment, the fixing device 100 includes the reflection plate 140 and the stay 160. However, the fixing device 100 may be assembled without the reflection plate 140 and the stay 160. In the above described embodiment, the halogen lamp 120 is employed as a heater. However, the infrared heater or carbon heater is available.

In the above described embodiment, the nip plate 130 is configured of the base portion 131 and the bending portion 132 extending upward from side ends of the base portion 131 in the front to rear direction, in order to increase the rigidity of the base portion 131 or to obviate the wear of the fusing film 110. However, the present invention is not limited to this configuration. The nip plate 130 may configured of only the base portion without the bending portion or may not be of plate shape.

In the above described embodiment, the pressure roller 150 is employed as a backup member for nipping the conveyed sheet in cooperation with the fusing member. However, the present invention is not limited to this configuration. The backup member can be a belt-shaped pressure member.

The fusing film may have the inner surface and an outer surface each provided with covering layer such as Teflon (registered trademarks) layer in order to reduce sliding friction thereof. In the present invention, if the fusing film has the covering layer, the protection layer of the nip plate should have hardness higher than that of the covering layer.

In the above described embodiment, the laser printer 1 is employed as an image forming device. However, the present invention is not limited to this configuration. LED printer in which an exposure is executed by LED, copier, or multifunctional device other than the printer is available. Although, the monochromatic image forming device is employed in the above described embodiment, a color image forming device is also available in the present invention.

What is claimed is:

1. A fixing device comprising:

a tubular flexible metallic fusing member having an inner peripheral surface made from metal and defining an internal space;

a heater disposed in the internal space;

a nip member disposed in the internal space for receiving radiant heat from the heater and having a contact surface configured to be in sliding contact with the inner peripheral surface, at least the contact surface being provided with a protection layer having a hardness higher than that of the inner peripheral surface; and a backup member that nips the tubular flexible metallic fusing member in cooperation with the nip member, wherein the protection layer comprises a planting layer formed on at least the contact surface, wherein the protection layer is subjected to baking treatment, and wherein the nip member comprises a main body made from one of aluminum and aluminum alloy, and the protection layer made from nickel-phosphor alloy.

2. The fixing device according to claim 1, wherein the contact surface has Vickers hardness higher than that of the inner peripheral surface.

3. The fixing device according to claim 1, wherein the nip member has an outer surface including the contact surface, and the outer surface is entirely covered with the protection layer.

4. The fixing device according to claim 1, wherein a thickness of the protection layer is in a range of 5 to 15 micrometers.

5. A fixing device comprising:

a tubular flexible metallic fusing member having an inner peripheral surface made from metal and defining an internal space;

a heater disposed in the internal space;

a nip member disposed in the internal space for receiving radiant heat from the heater and having a contact surface configured to be in sliding contact with the inner peripheral surface, at least the contact surface being provided with a protection layer having a hardness higher than that of the inner peripheral surface; and a backup member that nips the tubular flexible metallic fusing member in cooperation with the nip member, wherein the nip member comprises a main body made from a material, and the protection layer formed of a hardening layer by hardening a part of the material of the main body, and wherein the material of the main body is made from one of aluminum and aluminum alloy, and the hardening layer is made from alumite.

6. The fixing device according to claim 5, wherein the contact surface has Vickers hardness higher than that of the inner peripheral surface.

7. The fixing device according to claim 5 wherein the nip member has an outer surface including the contact surface, and the outer surface is entirely covered with the protection layer.

8. The fixing device according to claim 5, wherein a thickness of the protection layer is in a range of 5 to 15 micrometers.

9. A fixing device comprising:

a tubular flexible metallic fusing member having an inner peripheral surface made from metal and defining an internal space;

a nip member made from metal and having a contact surface configured to be in sliding contact with the inner peripheral surface, at least the contact surface being provided with a protection layer having a hardness higher than that of the inner peripheral surface; and a backup member that nips the tubular flexible metallic fusing member in cooperation with the nip member, wherein the protection layer comprises a plating layer formed on at least the contact surface, wherein the protection layer is subjected to banking treatment, and wherein the nip member comprises a main body made from one of aluminum and aluminum alloy, and the protection layer made from nickel-phosphor alloy.

10. The fixing device according to claim 9, wherein the contact surface has Vickers hardness higher than that of the inner peripheral surface.

11. The fixing device according to claim 9, wherein the nip member has an outer surface including the contact surface, and the outer surface is entirely covered with the protection layer.

12. The fixing device according to claim 9, wherein a thickness of the protection layer is in a range of 5 to 15 micrometers.

* * * * *